US006214068B1

(12) United States Patent
Ferronato

(10) Patent No.: US 6,214,068 B1
(45) Date of Patent: Apr. 10, 2001

(54) FLEXIBLE ABRASIVE MEMBER HAVING INTERLOCKING DEPOSITS

(76) Inventor: Sandro Giovanni Giuseppe Ferronato, Aeusserer Berg 3, CH-5408 Ennetbaden (CH)

( * ) Notice: Subject to any disclaimer, the term of this patent is extended or adjusted under 35 U.S.C. 154(b) by 0 days.

(21) Appl. No.: 09/202,297

(22) PCT Filed: Jun. 14, 1996

(86) PCT No.: PCT/NL96/00241

§ 371 Date: Mar. 22, 1999

§ 102(e) Date: Mar. 22, 1999

(87) PCT Pub. No.: WO97/47434

PCT Pub. Date: Dec. 18, 1997

(51) Int. Cl.[7] ..... B27D 11/00; B27D 11/02

(52) U.S. Cl. ..... 51/297; 51/293; 51/307; 51/309; 451/526

(58) Field of Search ..... 51/293, 297, 307, 51/309; 451/526, 527

(56) References Cited

U.S. PATENT DOCUMENTS 5,035,723 * 7/1991 Kallinowski e al. ..... 51/309
5,389,119 2/1995 Ferronato et al. .
5,654,078 * 8/1997 Ferronato ..... 51/293
5,681,217 * 10/1997 Hoopman et al. ..... 451/528

FOREIGN PATENT DOCUMENTS 64748 11/1982 (EP) .
642889 3/1995 (EP) .
657250 6/1995 (EP) .
2147606 3/1973 (FR) .
WO 96/07508 3/1996 (WO) .

OTHER PUBLICATIONS

International Search Report for PCT/NL96/00241 completed on Feb. 13, 1997.

* cited by examiner

*Primary Examiner*—Michael Marcheschi
(74) *Attorney, Agent, or Firm*—Handal & Morofsky

(57) ABSTRACT

A flexible abrasive member comprises a porous layer which carries deposits with embedded abrasive particles, said deposits being separated from each other. The deposits are arranged and shaped in such a way that they are mutually interlocked. Thereby, the tearing strength of the member is increased. As an example, the deposits may have cooperating convex and concave shapes. Also, the deposits may have hook-shaped or arrow-shaped protrusions which are hooked into each other.

17 Claims, 1 Drawing Sheet

FLEXIBLE ABRASIVE MEMBER HAVING INTERLOCKING DEPOSITS

The invention is related to a flexible abrasive member comprising a porous layer which carries deposits with embedded abrasive particles, said deposits being separated from each other.

Such flexible members are widely used for grinding and polishing. They are available as two general types, i.e. one type for dry grinding and one type for wet grinding. Flexible members of these types are known from U.S. Pat. No. 5,389,119. They can be manufactured in various ways, for instance by means of electroplating, electroless plating, gas deposition, sintering or screening by using resin.

These known flexible abrasive members have the disadvantage that the strength against disintegration, such as tearing, is too low. Generally, the porous layer consists of a mesh material which itself has a considerable tearing strength. However, after a regular pattern of closely spaced deposits has been applied onto said mesh, its tearing strength is much lower.

This loss in tearing strength can be attributed to the occurrence of nominal tear directions which are constituted by the tear lines or tear channels, lying between the rows of regularly spaced deposits. Once a small tear has been initiated, it propagates itself even under low tear forces due to these tear lines or tear channels.

The object of the invention is to provide a flexible abrasive member having separated deposits with embedded abrasive particles which still has an excellent tear strength. This object is achieved in that the deposits are arranged and shaped in such a way that they are mutually interlocked.

Any effort to tear the porous layer material will be counteracted by the interlocking shapes of the deposits, which themselves have an excellent resistance against the loads resulting from tear forces. On the other hand, the flexible character of the abrasive member is maintained, thanks to the spacing between the deposits.

The inventive concept of the invention can be carried out in various ways, provided the interlocking cooperation between the deposits is maintained. According to one of the possibilities, the deposits have cooperating convex and concave shapes. For instance, the deposits may have hook-shaped protrusions which are hooked into each other. Such protrusions may be S-shaped, or comprise two S-shapes which cross each other.

According to a further alternative, the deposits are arrow-shaped, for instance with the deposits each comprising three arrow-shapes pointing away from each other.

Also, the deposits may have blunt protrusions which fit between each other, such as deposits which are cross-shaped having four blunt protrusions pointing away from each other, or deposits having three blunt protrusions pointing away from each other.

The size of the deposits may lie between 2.5 and 15 mm.

An important advantage of the flexible abrasive member according to the invention is obtained by the mutual support of the adjacent deposits, which effect occurs due to the interlocking cooperation of the deposits. This support leads to a stabilization of the deposits, whereby their resistance against e.g. tilting under the influence of abrasive shear forces is greatly improved.

This favorable effect can in particular be used in grinding or polishing of e.g. granite. This material generally comprises relatively hard and soft areas. The deposits of these prior art flexible abrasive members have a tendency to dig into the softer parts of the granite. This normally results in an uneven surface, entailing loss of lustre and gloss.

According to the invention, the stabilised deposits show this tendency far less or not at all, giving a much better polishing or grinding result and a finer and smoother surface effect. As an example, with the flexible member according to the invention a higher gloss reading of about 5–10 can be achieved. Thus, the final polishing step is made easier and faster.

This important advantage of the flexible abrasive member according to the invention is related to its ability to maintain a plain grinding surface even while large grinding forces are exerted on the deposits. These grinding forces result in shear loadings on the deposit. As a result, the seperated deposits in traditional flexible abrasive members have the tendency to tilt under the influence of such grinding forces. The influence of this tendency to tilt manifests itself in particular in the softer parts of the above granite, which are less able to resist the tilting movement and are therefore ground away more deeply than the harder parts thereof. The product obtained has a less smooth surface, leading to a lower gloss.

In contrast, the deposits of a flexible abrasive member according to the invention are far less prone to such tilting movements. Having regard to the fact that these deposits are interlocked, they are able to exert a mutual stabilizing force on each other. Thus, all deposits are held in their correct position during grinding, which leads to a smoother and more accurate surface. The flexible abrasive member can therefore be used as a precision tool.

Also, the flexible abrasive member according to the invention is suitable for working small objects. Objects which are small in relation to the grinding surface of the flexible abrasive member, exert strong local forces on said member which could result in deformations of its surface due to tilting of the deposits. Here as well the interlocking relationship of the deposits in the flexible member according to the invention leads to better results. In particular, the flexible abrasive member carried out as a grinding or polishing belt benefits from the interlocking relationship of the deposits.

Furthermore, good results are also obtained in grinding or polishing the edge areas of platelike or blockshaped objects. These edge areas, which normally are formed by the intersection of two faces of such object which are at an angle of about 90 degrees, are exerting a concentrated load on the surface of the flexible abrasive member. Here as well, the interlocking relationship of the deposits results in a smoother and more plain edge surface.

The invention will now be explained further with reference to two embodiments shown in the figures.

Figure 1:
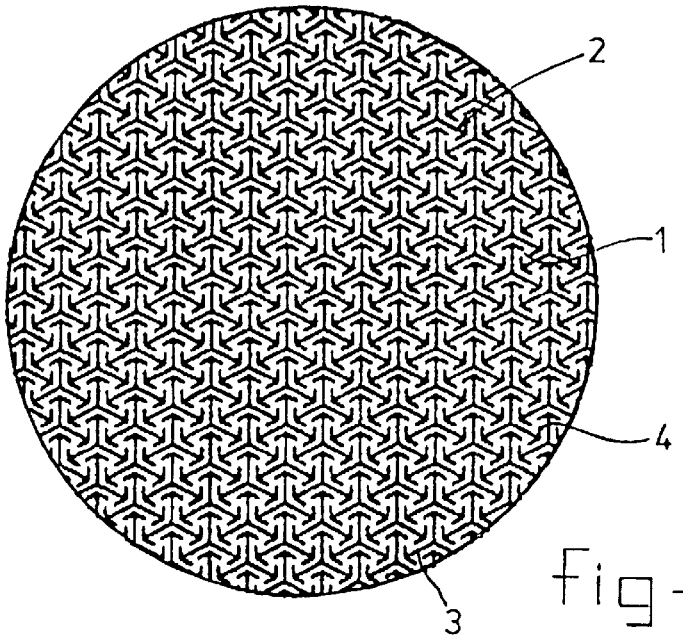
FIG. 1 shows a first embodiment of a flexible abrasive disc according to the invention.

The flexible abrasive disc as shown in FIG. 1 comprises a base member consisting of a porous layer 1. By means of a known technique, such as electro-plating, electrodeless plating, etc., deposits 2 are applied to the porous layer 1, in such a way that they are embedded therein. In the embodiment of FIG. 1, each deposit generally consists of three arrows, which mutually enclose angles of 120°. Each arrow of deposit 2 consists of a leg 3 and an arrow head 4.

As is clear from FIG. 1, the arrow heads 4 grip behind the arrow heads of neighboring deposits 2, which means that they prevent too large relative movements of neighboring deposits 2. For instance, in case the porous layer 1 would give way as a result of an initial tear, a further development of this tear is prevented due to the fact that the further relative movement of the deposits which are embedded in the porous layer 1, is prevented due to the fact that their arrow heads come to lie against eachother.

Figure 2:
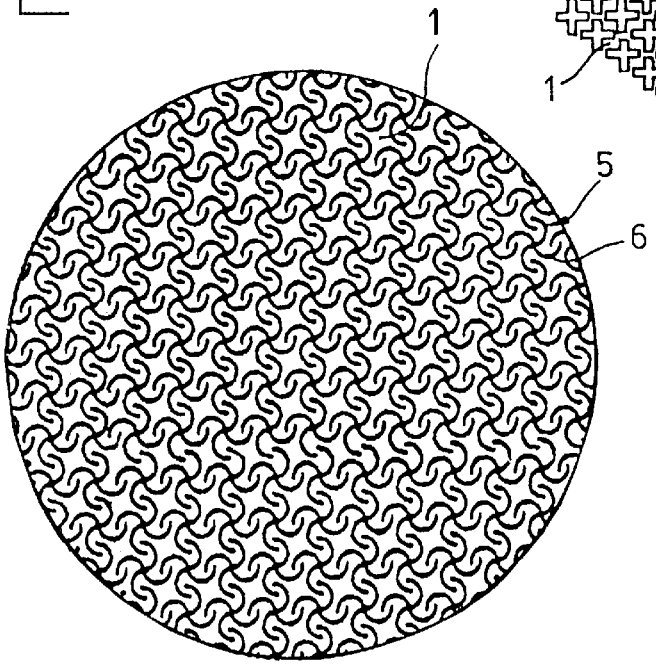
FIG. 2 shows a second embodiment.

It will be clear that numerous other embodiments are possible for the deposits to obtain the same effect. As an example, the embodiment of FIG. 2 is shown, comprising again a base member consisting of a porous layer 1, but now having cross-shaped deposits 5. The cross-shaped deposits 5 are each composed of crossing "S"-shapes 6, the ends of which hook behind eachother.

Figure 3:
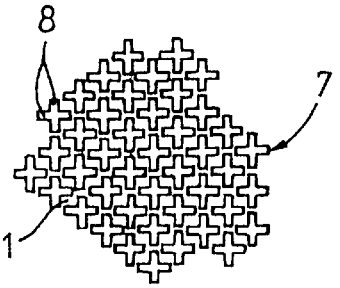
FIG. 3 shows a third embodiment.

In the partly shown embodiment of FIG. 3 a porous layer 1 comprises deposits 7 each having four blunt protrusions 8. These blunt protrusions 8 fit between eachother and thereby offer an interlocking relationship.

In the alternative of course also other deposits with more or less blunt protrusions could be provided.

What is claimed is:

1. A flexible abrasive member comprising a porous layer having a plurality of concave shaped abrasive particles and a plurality of convex shaped abrasive particles embedded therein, said abrasive particles being separated from each other, wherein the abrasive particles are arranged and shaped so that they interlock when a force is applied, such as during a grinding or polishing operation using said member.

2. A flexible abrasive member comprising a porous layer having a plurality of abrasive particles embedded therein, said abrasive particles being separated from each other, said abrasive particles having hooked shaped protrusions which are hooked into each other, wherein the abrasive particles are arranged and shaped so that they become interlocked when force is applied during a grinding or polishing operation using said member.

3. The member according to claim 2, wherein the abrasive particles are S shaped.

4. The member according claim 2, wherein each of the abrasive particles comprises two S shapes which cross each other.

5. The member according to claim 2, wherein the abrasive particles are arrow shaped.

6. The member according to claim 3, wherein each of the abrasive particles comprises three arrow shapes pointing away from each other.

7. The member according to claim 1, wherein the abrasive particles have blunt protrusions which fit between each other.

8. The member according to claim 7, wherein each of the abrasive particles is cross-shaped and has four blunt protrusions pointing away from each other.

9. The member according to claim 7, wherein each of the abrasive particles have three blunt protrusions pointing away from each other.

10. The member according to claim 1, wherein the abrasive particles have a size of between 2.5 and 15 mm.

11. A hand pad for grinding or polishing comprising the flexible member according to claim 1.

12. A belt for grinding or polishing comprising the flexible member according to claim 1.

13. A disc for grinding or polishing comprising the flexible member according to claim 1.

14. A block for grinding or polishing comprising the flexible member according to claim 1.

15. A flexible abrasive member comprising:

a) porous support layer; and b) a regular pattern of similarly shaped abrasive particles embedded on the support layer, each of the abrasive particles having a shape comprising at least three extensions radiating in opposed directions from a center;

wherein the particles are spatially separated from one another and are interfitted together with the extensions of each particle disposed between the extensions of adjacent abrasive particles so as to resist development of a tear line when the abrasive member is subject to tearing forces.

16. A member according to claim 15 wherein the particle extensions each have a hook-shaped configuration whereby adjacent abrasive particles can interlock when the abrasive member is subject to tearing forces.

17. A member according to claim 16 intended for grinding or polishing and having the form of a hand pad, a belt, a disc or a block.

* * * * *